US006950071B2

(12) United States Patent
Wen et al.

(10) Patent No.: US 6,950,071 B2
(45) **Date of Patent: *Sep. 27, 2005**

(54) MULTIPLE-ELEMENT ANTENNA

(75) Inventors: Geyi Wen, Waterloo (CA); Yihong Qi, Waterloo (CA); Krystyna Bandurska, Waterloo (CA); Perry Jarmuszewski, Guelph (CA)

(73) Assignee: Research In Motion Limited, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/613,109

(22) Filed: Jul. 2, 2003

(65) Prior Publication Data

US 2004/0004574 A1 Jan. 8, 2004

Related U.S. Application Data

(63) Continuation of application No. 10/119,079, filed on Apr. 9, 2002, now Pat. No. 6,664,930.
(60) Provisional application No. 60/283,311, filed on Apr. 12, 2001.

(51) Int. Cl.[7] ..... H01Q 1/24
(52) U.S. Cl. ..... 343/702; 343/795; 343/727
(58) Field of Search ..... 343/702, 700 MS, 343/795, 727, 730

(56) References Cited

U.S. PATENT DOCUMENTS

| | | | |
|---|---|---|---|
| 3,521,284 A | 7/1970 | Shelton et al. | 343/702 |
| 3,599,214 A | 8/1971 | Altamayer | 343/724 |
| 3,622,890 A | 11/1971 | Fujimoto et al. | 325/375 |
| 3,683,376 A | 8/1972 | Pronovost | 343/5 PD |
| 4,024,542 A | 5/1977 | Ikawa et al. | 343/702 |
| 4,074,270 A | 2/1978 | Kaloi | |
| 4,403,222 A | 9/1983 | Bitter, Jr. et al. | |

(Continued)

FOREIGN PATENT DOCUMENTS

| | | |
|---|---|---|
| EP | 0543645 | 5/1993 |
| EP | 0571124 | 11/1993 |
| EP | 0765001 | 3/1997 |
| EP | 0814536 | 12/1997 |

(Continued)

OTHER PUBLICATIONS

Microwave Journal, May 1984, p. 242, advertisement of Solitron/Microwave, XP002032716 various RF connectors with posts see left hand column.

Patent Abstracts of Japan, vol. 017, No. 264 (E–1370), May 24, 1993 & JP 05 007109 (Mitsubishi Electric Corp.), Jan. 14, 1993, abstract; figures 1–3, 5–7.

Patent Abstracts of Japan, vol. 018, No. 188 (E–1532), March 31, 1994 & JP 05 347507 A (Junkosha Co Ltd), Dec. 27, 1993, abstract; figures 1–19.

*Primary Examiner*—James Vannucci
(74) *Attorney, Agent, or Firm*—Jones Day; Krishna K. Pathiyal; Robert C. Liang

(57) ABSTRACT

A multiple-element antenna is provided that includes a monopole portion and a dipole portion. The monopole portion has a top section, a middle section, and a bottom section. The middle section defines a recess between the top and bottom sections, and the bottom section includes a monopole feeding port configured to couple the monopole portion of the multiple-element antenna to communications circuitry in a mobile communication device. The dipole portion has at least one dipole feeding port configured to couple the dipole portion of the multiple-element antenna to communications circuitry in the mobile communications device. The dipole portion of the multiple-element antenna is positioned within the recess defined by the monopole portion of the multiple-element antenna in order to electromagnetically couple the monopole portion with the dipole portion.

18 Claims, 4 Drawing Sheets

U.S. PATENT DOCUMENTS

| | | | | | |
|---|---|---|---|---|---|
| 4,471,493 | A | | 9/1984 | Schober | 455/90 |
| 4,504,834 | A | | 3/1985 | Garay et al. | 343/749 |
| 4,543,581 | A | | 9/1985 | Nemet | 343/702 |
| 4,571,595 | A | * | 2/1986 | Phillips et al. | 343/745 |
| 4,584,709 | A | | 4/1986 | Kneisel et al. | 455/78 |
| 4,590,614 | A | | 5/1986 | Erat | 455/270 |
| 4,692,769 | A | | 9/1987 | Gegan | |
| 4,730,195 | A | | 3/1988 | Phillips et al. | 343/792 |
| 4,839,660 | A | | 6/1989 | Hadzoglou | 343/715 |
| 4,847,629 | A | | 7/1989 | Shimazaki | 343/901 |
| 4,857,939 | A | | 8/1989 | Shimazaki | 343/715 |
| 4,890,114 | A | | 12/1989 | Egashira | 343/702 |
| 4,894,663 | A | | 1/1990 | Urbish et al. | 343/702 |
| 4,975,711 | A | | 12/1990 | Lee | 343/702 |
| 5,030,963 | A | | 7/1991 | Tadama | 343/702 |
| 5,138,328 | A | | 8/1992 | Zibrik et al. | 343/702 |
| 5,214,434 | A | | 5/1993 | Hsu | 343/702 |
| 5,218,370 | A | | 6/1993 | Blaese | 343/702 |
| 5,227,804 | A | | 7/1993 | Oda | 343/702 |
| 5,245,350 | A | | 9/1993 | Sroka | 343/702 |
| 5,257,032 | A | | 10/1993 | Diamond et al. | |
| 5,347,291 | A | | 9/1994 | Moore | 343/749 |
| 5,373,300 | A | | 12/1994 | Jenness et al. | 343/102 |
| 5,420,599 | A | | 5/1995 | Erkocevic | 343/828 |
| 5,422,651 | A | | 6/1995 | Chang | 343/749 |
| 5,451,965 | A | | 9/1995 | Matsumoto | 343/702 |
| 5,451,968 | A | | 9/1995 | Emery | 343/749 |
| 5,457,469 | A | | 10/1995 | Diamond et al. | |
| 5,489,914 | A | | 2/1996 | Breed | |
| 5,493,702 | A | | 2/1996 | Crowley et al. | 455/89 |
| 5,541,609 | A | | 7/1996 | Stutzman et al. | |
| 5,684,672 | A | | 11/1997 | Karidis et al. | 343/702 |
| 5,701,128 | A | | 12/1997 | Okada et al. | |
| 5,767,811 | A | | 6/1998 | Mandai et al. | |
| 5,821,907 | A | | 10/1998 | Zhu et al. | |
| 5,841,403 | A | | 11/1998 | West | |
| 5,870,066 | A | | 2/1999 | Asakura et al. | |
| 5,872,546 | A | | 2/1999 | Ihara et al. | |
| 5,903,240 | A | | 5/1999 | Kawahata et al. | |
| 5,966,098 | A | | 10/1999 | Qi et al. | |
| 5,973,651 | A | | 10/1999 | Suesada et al. | |
| 5,977,920 | A | | 11/1999 | Hung | |
| 5,990,838 | A | | 11/1999 | Burns et al. | |
| 6,008,773 | A | * | 12/1999 | Matsuoka et al. | 343/818 |
| 6,028,568 | A | | 2/2000 | Asakura et al. | |
| 6,031,505 | A | | 2/2000 | Qi et al. | |
| 6,034,639 | A | | 3/2000 | Rawlins et al. | |
| 6,140,966 | A | | 10/2000 | Pankinaho | |
| 6,329,951 | B1 | * | 12/2001 | Wen et al. | 343/702 |
| 6,335,706 | B1 | * | 1/2002 | Elliot | 343/727 |
| 6,337,667 | B1 | | 1/2002 | Ayala et al. | |
| 6,408,190 | B1 | | 6/2002 | Ying | |
| 6,456,249 | B1 | | 9/2002 | Johnson et al. | |
| 6,515,634 | B2 | | 2/2003 | Desclos et al. | |
| 6,664,930 | B2 | * | 12/2003 | Wen et al. | 343/702 |
| 6,781,548 | B2 | | 8/2004 | Wen et al. | |
| 6,791,500 | B2 | | 9/2004 | Qi et al. | |
| 2001/0001554 | A1 | | 5/2001 | Oshiyama | |
| 2001/0050643 | A1 | | 12/2001 | Egorov et al. | |
| 2002/0101380 | A1 | | 8/2002 | Pruss et al. | |
| 2002/0140607 | A1 | | 10/2002 | Zhou | |
| 2003/0011521 | A1 | | 1/2003 | Edimo et al. | |

FOREIGN PATENT DOCUMENTS

| | | |
|---|---|---|
| EP | 0892459 | 1/1999 |
| EP | 1018779 | 7/2000 |
| EP | 1172885 | 1/2002 |
| EP | 1189304 | 3/2002 |
| EP | 1296410 | 3/2003 |
| EP | 1304765 | 4/2003 |
| GB | 2330951 | 5/1999 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 06097712 | 4/1994 |
| JP | 6204908 | 7/1994 |
| WO | 9638881 | 5/1996 |
| WO | 9733338 | 9/1997 |
| WO | 9812771 | 3/1998 |
| WO | 9903166 | 1/1999 |
| WO | 9925042 | 5/1999 |
| WO | 0001028 | 1/2000 |
| WO | 0171844 | 9/2001 |
| WO | 0178192 | 10/2001 |
| WO | 0191236 | 11/2001 |
| WO | 02054539 | 7/2002 |
| WO | 03047031 | 6/2003 |

* cited by examiner

MULTIPLE-ELEMENT ANTENNA

CROSS-REFERENCE TO RELATED APPLICATION

This application claims priority as a continuation of U.S. patent application Ser. No. 10/119,079 filed Apr. 9, 2002, now U.S. Pat. No. 6,664,930. U.S. patent application Ser. No. 10/119,079 claims priority from and is related to the following prior application: A Multiple-Element Antenna For A Mobile Communication Device, U.S. Provisional Application No. 60/283,311, filed Apr. 12, 2001. These prior applications, including the entire written descriptions and drawing figures, are hereby incorporated into the present application by reference.

FIELD OF THE INVENTION

This invention relates generally to the field of multi-feed antennas. More specifically, a multiple-element antenna is provided that is particularly well-suited for use in Personal Digital Assistants, cellular telephones, and wireless two-way email communication devices (collectively referred to herein as "mobile communication devices").

BACKGROUND OF THE INVENTION

Mobile communication devices having antenna structures that support dual-band communication are known. Many such mobile devices utilize helix or "inverted F" antenna structures, where a helix antenna is typically installed outside of a mobile device, and an inverted F antenna is typically embedded inside of a case or housing of a device. Generally, embedded antennas are preferred over external antennas for mobile communication devices because they exhibit a lower level of SAR (Specific Absorption Rate), which is a measure of the rate of energy absorbed by biological tissues. Many known embedded antenna structures such as the inverted F antenna, however, still exhibit undesirably high SAR levels, and may also provide poor communication signal radiation and reception in many environments.

SUMMARY

A multiple-element antenna includes a monopole portion and a dipole portion. The monopole portion has a top section, a middle section, and a bottom section. The middle section defines a recess between the top and bottom sections, and the bottom section includes a monopole feeding port configured to couple the monopole portion of the multiple-element antenna to communications circuitry in a mobile communication device. The dipole portion has at least one dipole feeding port configured to couple the dipole portion of the multiple-element antenna to communications circuitry in the mobile communications device. The dipole portion of the multiple-element antenna is positioned within the recess defined by the monopole portion of the multiple-element antenna in order to electromagnetically couple the monopole portion with the dipole portion.

DETAILED DESCRIPTION

Figure 1:
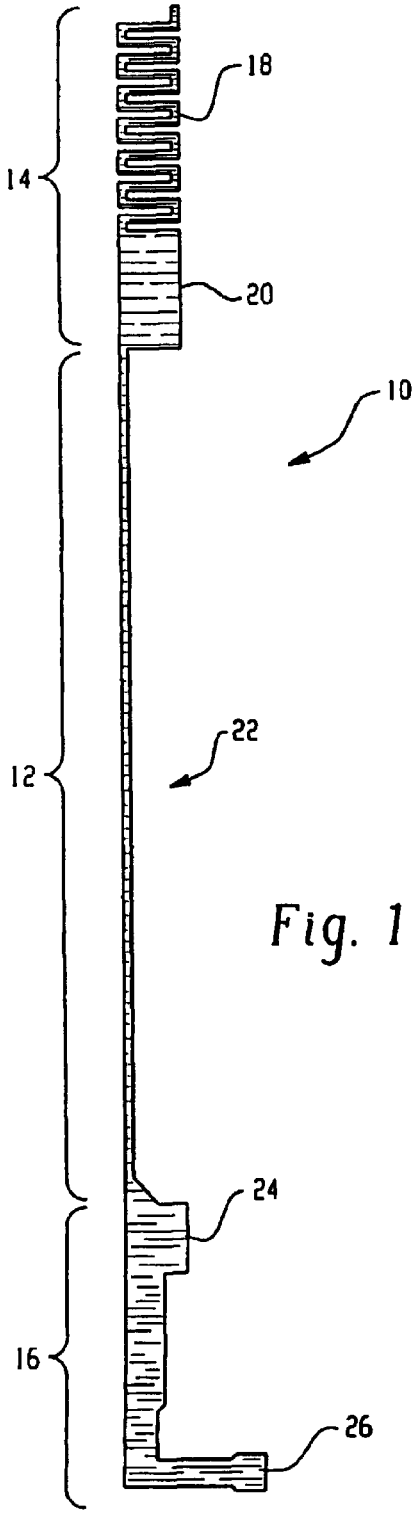
FIG. 1 is a top view of a monopole portion of an exemplary multiple-element antenna.
Figure 2:
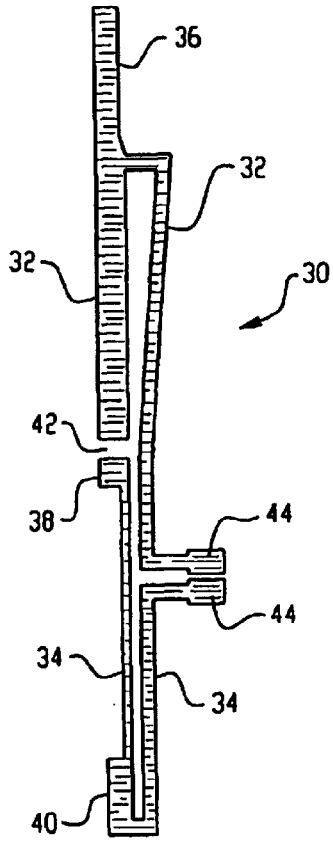
FIG. 2 is a top view of a dipole portion of the exemplary multiple-element antenna.
Figure 3:
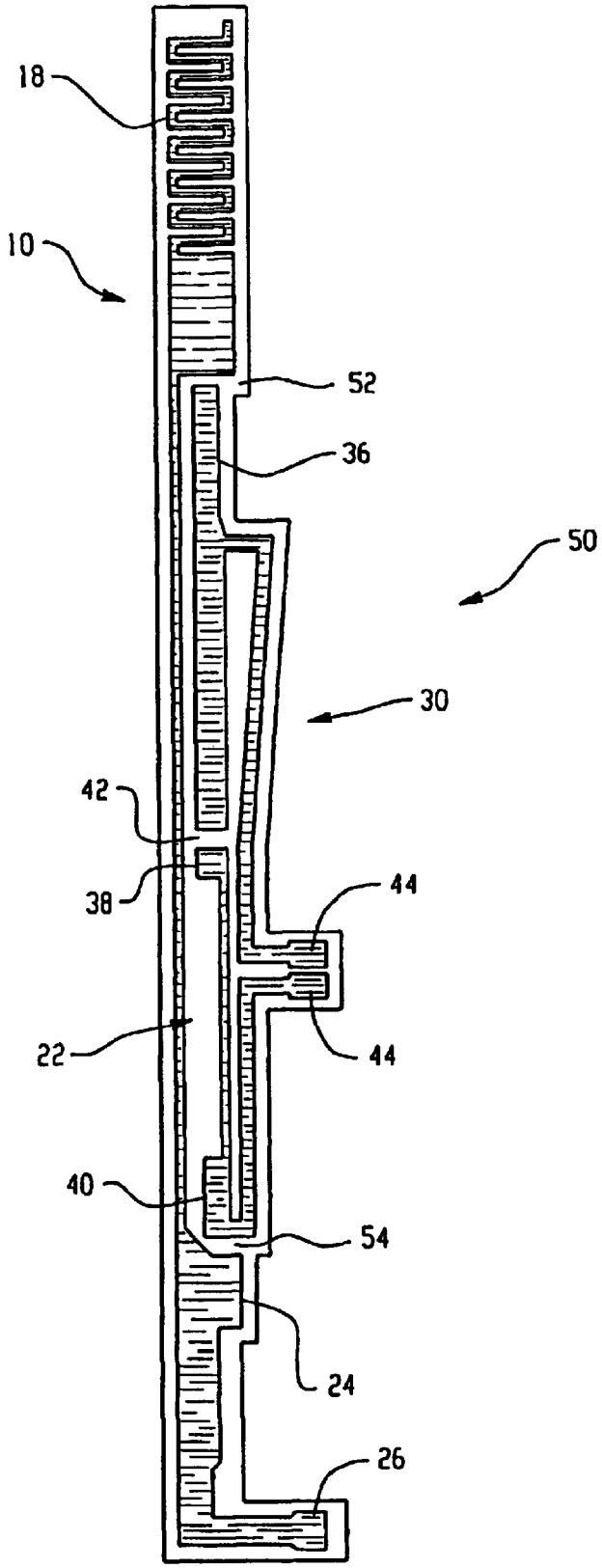
FIG. 3 is a top view of the exemplary multiple-element antenna with both its monopole and dipole portions.

Referring now to the drawing figures, FIGS. 1–3 show an exemplary multiple-element antenna 50. FIG. 1 is an illustration of a monopole portion 10 of the multiple-element antenna 50, FIG. 2 illustrates a dipole portion 30 of the multiple-element antenna 50, and FIG. 3 shows the multiple-element antenna 50 with both its monopole 10 and dipole 30 portions.

Operationally, the monopole 10 and dipole 30 portions of the antenna 50 may each be tuned to a different frequency band, thus enabling the multiple-element antenna 50 to function as the antenna in a dual-band mobile communication device. For example, the multiple-element antenna 50 may be adapted for operation at the General Packet Radio Service (GPRS) frequency bands of 900 Mhz and 1800 Mhz, the Code Division Multiple Access (CDMA) frequency bands of 800 Mhz and 1900 Mhz, or some other pair of frequency bands.

With reference to FIG. 1, the monopole portion 10 of the antenna 50 includes a middle section 12, a top section 14, and a bottom section 16. The top section 14 includes a meandering line 18 that is used to adjust the conductor length of the monopole 10 in order to tune it to a particular operating frequency. The meandering line 18 top-loads the monopole 10 such that it operates as though its length were greater than its actual physical dimension. The length of the meandering line 18, and thus the total conductor length of the monopole 10, may be adjusted, for example, by shorting together one or more segments of the meandering line 18 to form a solid conductor portion 20. For instance, in the illustrated embodiment 10, approximately one-third of the top section 14 is comprised of the solid conductor portion 20, and the remaining two-thirds is comprised of the meandering line 18.

The middle section 12 of the monopole 10 is a thin conductive strip which defines a recess 22 between the top and bottom sections 14, 16. The length of the middle section 12 is sized such that the dipole portion 30 of the multiple-element antenna 50 may be positioned within the recess 22, as shown in FIG. 3, thus electromagnetically coupling the monopole portion 10 with the dipole portion 30. The electromagnetic coupling between the monopole and dipole portions 10, 30 of the antenna 50 is discussed in more detail below with reference to FIG. 3.

Figure 4:
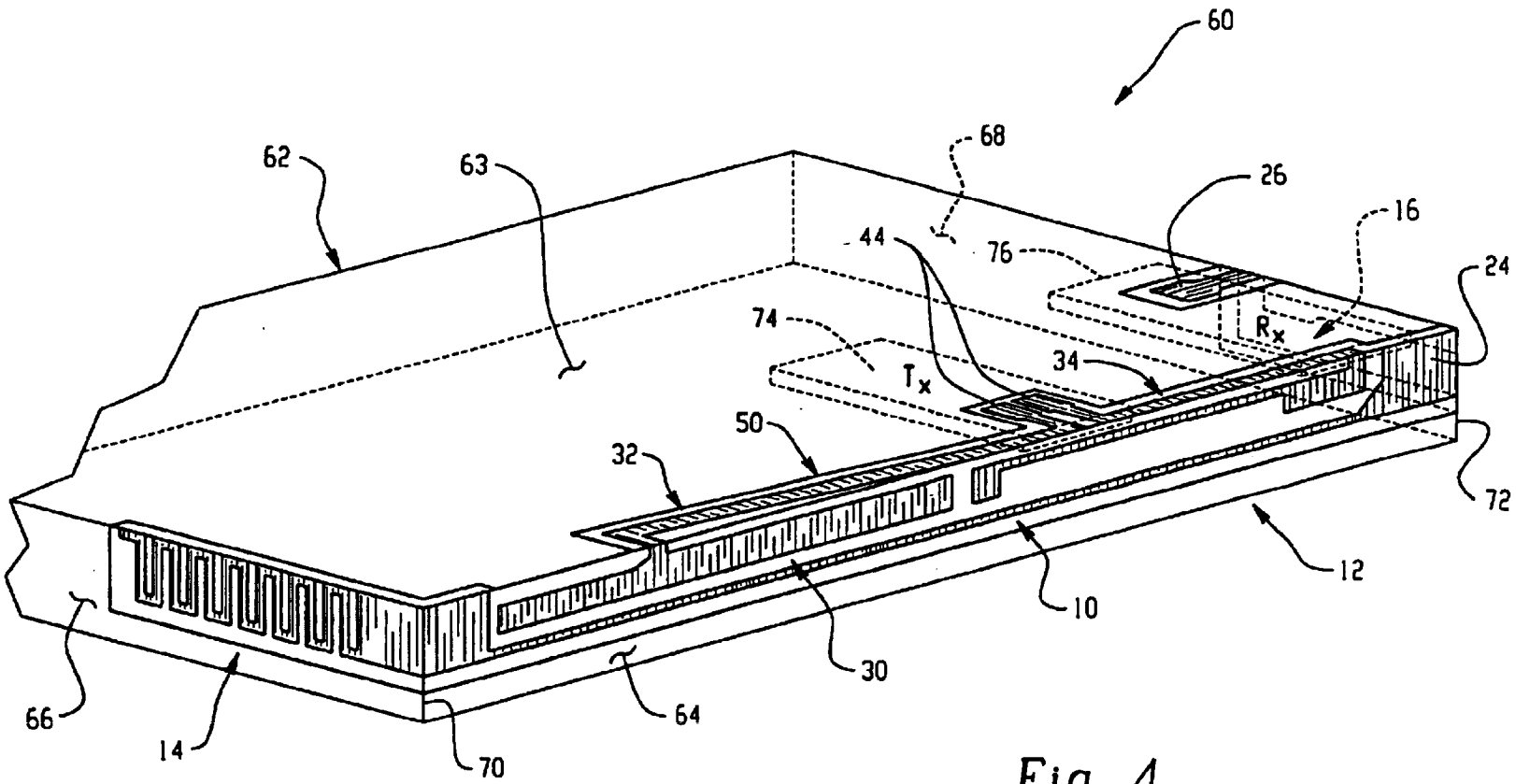
FIG. 4 is an orthogonal view of the exemplary multiple-element antenna shown in FIG. 3 mounted in a mobile communication device.

The bottom section 16 of the monopole 10 includes a gain patch 24 and a feeding port 26. The gain patch 24 is fabricated at a critical electromagnetic coupling point with the dipole portion 30 and thus affects the gain of the monopole 10 at its operating frequency. The effect of the gain patch 24 on the gain of the monopole 10 is discussed in more detail below with reference to FIG. 3. The feeding port 26 couples the monopole portion 10 of the antenna 50 to communications circuitry. For example, the feeding port 26 may couple the monopole portion 10 of the antenna 50 to a receiver 76 in a mobile communications device 60 as illustrated in FIG. 4.

Referring now to FIG. 2, the dipole portion 30 of the antenna 50 includes a first conductor section 32 and a second conductor section 34. The first and second conductor sections 32, 34 of the dipole 30 are positioned to define a gap 42, thus forming an open-loop structure known as an open folded dipole antenna. In alternative embodiments, other known dipole antenna designs may be utilized, such as a closed folded dipole structure.

The first conductor section 32 of the dipole 30 includes a top load 36 that may be used to set the operating frequency of the dipole 30. The dimensions of the top load 36 affect the total conductive length of the dipole 30, and thus may be adjusted to tune the dipole 30 to a particular operating frequency. For example, decreasing the size of the top load 36 increases the operating frequency of the dipole 30 by decreasing its total conductive length. In addition, the operating frequency of the dipole 30 may be further tuned by adjusting the size of the gap 42 between the conductor sections 32, 34, or by altering the dimensions of other portions of the dipole 30.

The second conductor section 34 includes a stability patch 38 and a load patch 40. The stability patch 38 is a controlled coupling patch which affects the electromagnetic coupling between the first and second conductor sections 32, 34 at the operating frequency of the dipole 30. The electromagnetic coupling between the conductor sections 32, 34 is further affected by the size of the gap 42 which may be set in accordance with desired antenna characteristics. The electromagnetic coupling of the dipole 30 is discussed in more detail below with reference to FIG. 3. Similarly, the dimensions of the load patch 40 affect the electromagnetic coupling with the gain patch 24 in the monopole portion 10 of the antenna 50, and thus may enhance the gain of the dipole 30 at its operating frequency, as described in more detail below with reference to FIG. 3

In addition, the dipole includes two feeding ports 44, one of which is connected to the first conductor section 32 and the other of which is connected to the second conductor section 34. The feeding ports 44 are offset from the gap 42 between the conductor sections 32, 34, resulting in a structure commonly referred to as an "offset feed" open folded dipole antenna. However, the feeding ports 44 need not necessarily be offset from the gap 42, and may be positioned for example to provide space for or so as not to physically interfere with other components of a communication device in which the antenna 50 (shown in FIG. 3) is implemented. The feeding ports 44 couple the dipole portion 30 of the antenna 50 to communications circuitry. For example, the feeding ports 44 may couple the dipole 30 to a transmitter 74 in a mobile communications device 60 as illustrated in FIG. 4.

Referring now to FIG. 3, the multiple-element antenna 50 is fabricated with the dipole portion 30 positioned within the recess 22 of the monopole portion 10. The antenna structure 50 may, for example, be fabricated with a copper conductor on a flexible dielectric substrate 52 using known copper etching techniques. The antenna structures 10, 30 are fabricated such that the top load 36 of the dipole 30 is in close proximity with the top section 14 (FIG. 2) of the monopole 10 and the load patch 40 of the dipole 30 is closely aligned with the gain patch in the monopole 10. The proximity of the dipole portion 30 to the monopole portion 10 results in electromagnetic coupling between the two antenna structures 10, 30. In this manner, each antenna structure 10, 30 acts as a parasitic element to the other antenna structure 10, 30, thus improving antenna 50 performance by lowering the SAR and increasing the gain and bandwidth at both the operating frequencies of the dipole and monopole portions 10, 30.

The relative positioning of the load patch 40 in the dipole 30 and the gain patch 24 in the monopole 10 define a frequency enhancing gap 54 between the two antenna structures 10, 30, which enhances the gain and bandwidth of the antenna 50. These enhancements result from the electromagnetic coupling between the gain and load patches 24, 40 across the gap 54 which increases the effective aperture of the monopole 10 and dipole 30 at their respective operating frequencies. The size of the gap 54 controls this coupling and thus may be adjusted to control the gain and bandwidth of the monopole 10 and dipole 30 portions of the antenna 50.

With respect to the dipole portion 30 of the antenna 50, the gain may be further controlled by adjusting the dimensions of the stability patch 38 and the size of the gap 42 between the first and second conductor sections 32, 34 of the dipole 30. For example, the gap 42 may be adjusted to tune the dipole 30 to a selected operating frequency by optimizing antenna gain performance at the particular operating frequency. In addition, the dimensions of the stability patch 38 and gap 42 may be selected to control the input impedance of the dipole 30 in order to optimize impedance matching between the dipole 30 and external circuitry, such as the transmitter illustrated in FIG. 4.

With respect to the monopole portion 10 of the antenna 50, the gain may be further controlled by adjusting the length of the meandering line 18. In addition to adjusting the operating frequency of the monopole 10, as discussed above with reference to FIG. 1, the length of the meandering line 18 also affects the gain of the monopole 10.

It should be understood, however, that the dimension, shape and orientation of the various patches, gaps and other elements affecting the electromagnetic coupling between the monopole 10 and dipole 30 portions of the antenna 50 are shown for illustrative purposes only, and may be modified to achieve desired antenna characteristics.

FIG. 4 is an orthogonal view of the exemplary multiple-element antenna 50 shown in FIG. 3 mounted in a mobile communication device 60. The mobile communication device 60 includes a dielectric housing 62 having a top surface 63, a front surface 64, a first side surface 66, and a second side surface 68. In addition, the mobile communication device 60 includes a transmitter 74 and a receiver 76 mounted within the dielectric housing 62.

The multiple-element antenna structure 50, including the flexible dielectric substrate 52 on which the antenna 50 is fabricated, is mounted on the inside of the dielectric housing 62. The antenna 50 and its flexible substrate 52 are folded from the original, flat configuration illustrated in FIG. 3, such that they extend around the inside surface of the dielectric housing 62 to orient the antenna structure 50 in multiple perpendicular planes. The top section 14 of the monopole portion 10 of the antenna 50 is mounted on the first side surface 66 of the dielectric housing 62 and extends from the first side surface 66 around a front corner 70 to the front surface 64 of the dielectric housing 62. The middle section 12 of the monopole 10 extends fully across the front surface 64 of the dielectric housing 62. The bottom section 16 of the monopole 16 is folded to extend from the front surface 64 of the housing 62 around another front comer 72 to the second side surface 68, such that the gain patch 24 is mounted on the front surface 64. The bottom section 16 is then folded a second time to extend from the second side surface 68 to the top surface 63, such that the monopole feeding port 26 is mounted on the top surface 63 of the housing 62 relative to the receiver circuitry 76.

The dipole portion 30 of the antenna 50 is folded and mounted across the front and top surfaces 64, 63 of the dielectric housing 62, such that the dipole feeding ports 44 are mounted on the top surface 63 and the conductor sections 32, 34 are mounted partially on the front surface 64 and partially on the top surface 63. The dipole feeding ports 44 are positioned on the top surface 63 of the dielectric housing 62 relative to the transmitter circuitry 74.

The monopole feeding port 26 is coupled to the input of the receiver 76, and the dipole feeding ports 44 are coupled to the output of the transmitter 74. The operation of the mobile communication device 60 along with the transmitter 74 and receiver 76 is described in more detail below with reference to FIG. 5.

Figure 5:
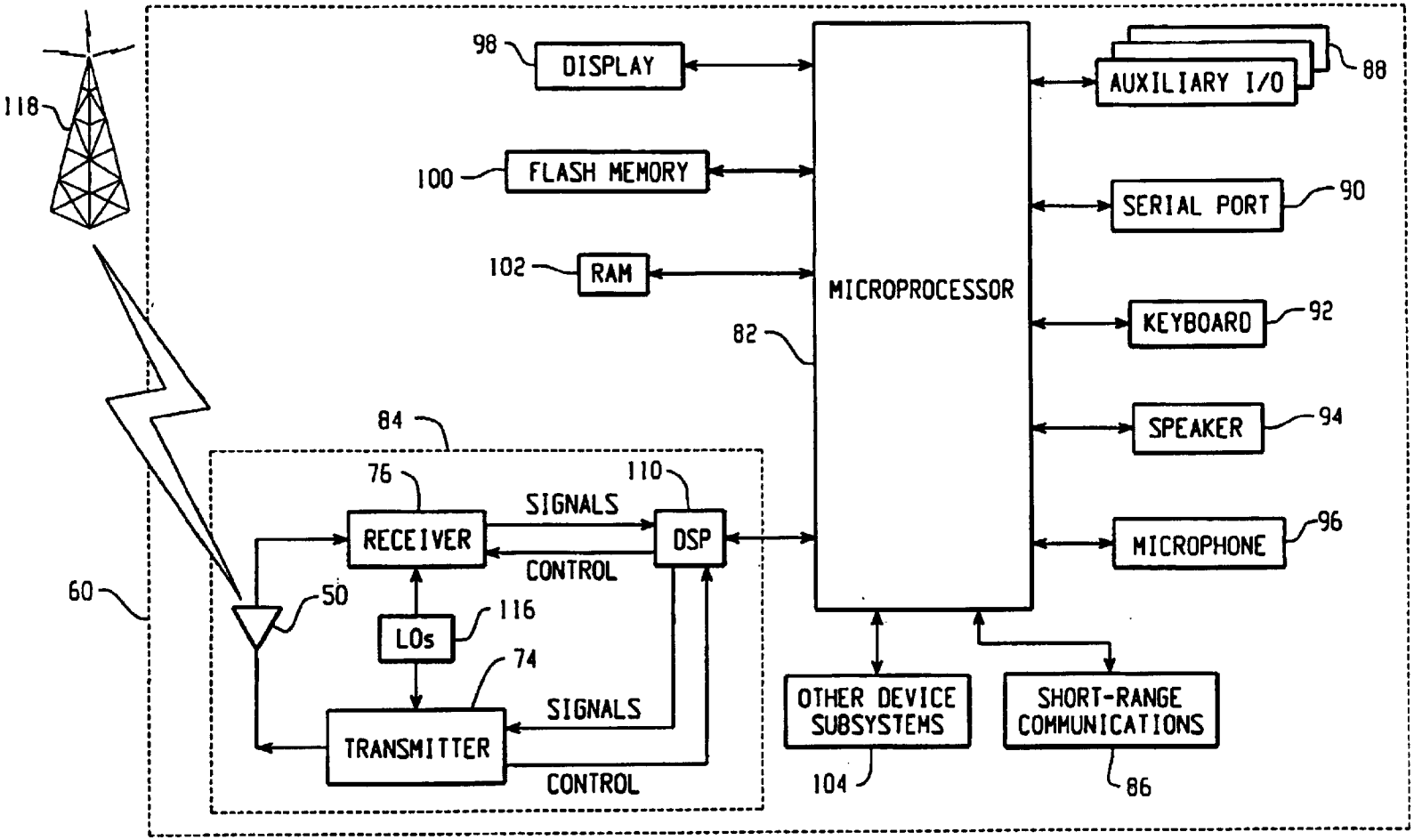
FIG. 5 is a block diagram of the mobile communication device illustrated in FIG. 4.

FIG. 5 is a block diagram of the mobile communication device 60 illustrated in FIG. 4. The mobile communication device 60 includes a processing device 82, a communications subsystem 84, a short-range communications subsystem 86, input/output devices 88–98, memory devices 100, 102, and various other device subsystems 104. The mobile communication device 60 is preferably a two-way communication device having voice and data communication capabilities. In addition, the device 60 preferably has the capability to communicate with other computer systems via the Internet.

The processing device 82 controls the overall operation of the mobile communications device 60. Operating system software executed by the processing device 82 is preferably stored in a persistent store, such as a flash memory 100, but may also be stored in other types of memory devices, such as a read only memory (ROM) or similar storage element. In addition, system software, specific device applications, or parts thereof, may be temporarily loaded into a volatile store, such as a random access memory (RAM) 102. Communication signals received by the mobile device 60 may also be stored to RAM.

The processing device 82, in addition to its operating system functions, enables execution of software applications on the device 60. A predetermined set of applications that control basic device operations, such as data and voice communications, may be installed on the device 60 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 118. Preferably, the PIM data items are seamlessly integrated, synchronized and updated via the wireless network 118 with the device user's corresponding data items stored or associated with a host computer system. An example system and method for accomplishing these steps is disclosed in "System And Method For Pushing Information From A Host System To A Mobile Device Having A Shared Electronic Address," U.S. Pat. No. 6,219,694, which is owned by the assignee of the present application, and which is hereby incorporated into the present application by reference.

Communication functions, including data and voice communications, are performed through the communication subsystem 84, and possibly through the short-range communications subsystem 86. The communication subsystem 84 includes the receiver 76, the transmitter 74 and the multiple-element antenna 50, as shown in FIG. 4. In addition, the communication subsystem 84 also includes a processing module, such as a digital signal processor (DSP) 110, and local oscillators (LOs) 116. The specific design and implementation of the communication subsystem 84 is dependent upon the communication network in which the mobile device 60 is intended to operate. For example a device destined for a North American market may include a communication subsystem 84 designed to operate within the Mobitex™ mobile communication system or DataTAC™ mobile communication system, whereas a device intended for use in Europe may incorporate a General Packet Radio Service (GPRS) communication subsystem.

Network access requirements vary depending upon the type of communication system. For example, in the Mobitex and DataTAC networks, mobile communications devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile communication device 60 may send and receive communication signals over the communication network 118. Signals received by the monopole portion 10 of the multiple-element antenna 50 through the communication network 118 are input to the receiver 76, which may perform such common receiver functions as signal amplification, frequency down conversion, filtering, channel selection, and analog-to-digital conversion. Analog-to-digital conversion of the received signal allows the DSP to perform more complex communication functions, such as demodulation and decoding. In a similar manner, signals to be transmitted are processed by the DSP 110, and are the input to the transmitter 74 for digital-to-analog conversion, frequency up-conversion, filtering, amplification and transmission over the communication network via the dipole portion 30 of the multiple-element antenna 50.

In addition to processing communication signals, the DSP 110 provides for receiver 76 and transmitter 74 control. For example, gains applied to communication signals in the receiver 76 and transmitter 74 may be adaptively controlled through automatic gain control algorithms implemented in the DSP 110.

In a data communication mode, a received signal, such as a text message or web page download, is processed by the communication subsystem 84 and input to the processing device 82. The received signal is then further processed by the processing device 82 for output to a display 98, or alternatively to some other auxiliary I/O device 88. A device user may also compose data items, such as e-mail messages, using a keyboard 92, such as a QWERTY-style keyboard, and/or some other auxiliary I/O device 88, such as a touchpad, a rocker switch, a thumb-wheel, or some other type of input device. The composed data items may then be transmitted over the communication network 118 via the communication subsystem 84.

In a voice communication mode, overall operation of the device is substantially similar to the data communication mode, except that received signals are output to a speaker 94, and signals for transmission are generated by a microphone 96. Alternative voice or audio I/O subsystems, such as a voice message recording subsystem, may also be implemented on the device 60. In addition, the display 98 may also be utilized in voice communication mode, for example to display the identity of a calling party, the duration of a voice call, or other voice call related information.

The short-range communications subsystem 86 enables communication between the mobile communications device 60 and other proximate systems or devices, which need not necessarily be similar devices. For example, the short-range communications subsystem 86 may include an infrared device and associated circuits and components, or a Bluetooth™ communication module to provide for communication with similarly-enabled systems and devices.

This written description uses examples to disclose the invention, including the best mode, and also to enable any person skilled in the art to make and use the invention. The patentable scope of the invention is defined by the claims, and may include other examples that occur to those skilled in the art.

We claim:

1. A multiple-element antenna for use with a mobile communication device having a transmitter and a receiver, wherein the multiple-element antenna includes a monopole portion coupled to the receiver and a dipole portion coupled to the transmitter, the multiple-element antenna comprising:

a single dielectric substrate; and the monopole portion and the dipole portion fabricated on the single dielectric substrate;

wherein the dipole portion is fabricated in close proximity to the monopole portion in order to electromagnetically couple the monopole portion with the dipole portion.

2. The multiple-element antenna of claim 1, wherein the multiple-element antenna is mounted on at least one inside surface of the mobile communication device.

3. The multiple-element antenna of claim 1, wherein the mobile communication device is a dual-band mobile communication device, and wherein the monopole portion is tuned to a first operating frequency and the dipole portion is tuned to a second operating frequency.

4. The multiple-element antenna of claim 1, wherein the mobile communication device is selected from the group consisting of: a Personal Digital Assistant, a cellular telephone, and a wireless two-way email communication device.

5. The multiple-element antenna of claim 1, wherein the single dielectric substrate is a flexible dielectric substrate.

6. The multiple-element antenna of claim 1, wherein:

the monopole portion includes a top section, a middle section and a bottom section, the middle section defining a recess between the top and bottom sections, and the bottom section including a monopole feeding port configured to couple the monopole portion to communications circuitry in the mobile communication device;

the dipole portion having at least one dipole feeding port configured to couple the dipole portion to communications circuitry in the mobile communication device; and the dipole portion being positioned within the recess in order to electromagnetically couple the monopole portion with the dipole portion.

7. The multiple-element antenna of claim 6, wherein the top section of the monopole portion includes a meandering line.

8. The multiple-element antenna of claim 7, wherein the conductor length of the meandering line is pre-selected to tune the monopole portion to an operating frequency.

9. The multiple-element antenna of claim 1, wherein the dipole portion is an open folded dipole antenna.

10. The multiple-element antenna of claim 1, wherein the dipole portion is an offset feed, open folded dipole antenna.

11. The multiple-element antenna of claim 1, wherein the dipole portion includes a top load.

12. The multiple-element antenna of claim 11, wherein the dimensions of the top load are pre-selected to tune the dipole portion to an operating frequency.

13. The multiple-element antenna of claim 1, wherein the dipole portion includes a first conductor section and a second conductor section.

14. The multiple-element antenna of claim 13, wherein the first and second conductor sections define a gap.

15. The multiple-element antenna of claim 14, wherein the size of the gap is pre-selected to set the gain of the dipole portion.

16. The multiple-element antenna of claim 6, wherein the monopole feeding port couples the monopole portion to a receiver in the mobile communication device.

17. The multiple-element antenna of claim 6, wherein the dipole feeding port couples the dipole portion to a transmitter in the mobile communication device.

18. The multiple-element antenna of claim 2, wherein the single dielectric substrate is folded to mount the multiple-element antenna to a plurality of perpendicular inside surfaces of the mobile communication device.

* * * * *